United States Patent [19]

Hiller

[11] 3,955,756

[45] May 11, 1976

[54] SOLID-SHELL SCREW-CONVEYOR CENTRIFUGE

[75] Inventor: Georg Hiller, Vilsbiburg, Germany

[73] Assignee: Flottweg-Werk, Dr. Georg Bruckmayer, Vilsbiburg, Germany

[22] Filed: June 21, 1972

[21] Appl. No.: 264,872

[30] Foreign Application Priority Data

June 21, 1971 Germany ..... 2130633

[52] U.S. Cl. ..... 233/7; 233/46

[51] Int. Cl. ..... B04b 1/20; B04b 7/02

[58] Field of Search ..... 233/1 R, 3, 7, 21, 27, 233/28, 46, 1 A

[56] References Cited

UNITED STATES PATENTS

| | | | |
|---|---|---|---|
| 3,268,159 | 8/1966 | Kern | 233/7 |
| 3,285,507 | 11/1966 | Shapiro | 233/7 |
| 3,620,442 | 11/1971 | Halloran | 233/7 |

FOREIGN PATENTS OR APPLICATIONS

| | | | |
|---|---|---|---|
| 1,194,780 | 6/1965 | Germany | 233/7 |
| 1,497,376 | 8/1967 | France | 233/7 |
| 116,858 | 2/1970 | Denmark | 233/7 |
| 2,054,722 | 5/1971 | France | 233/7 |
| 1,271,244 | 7/1961 | France | 233/7 |
| 116,858 | 2/1970 | Denmark | 233/7 |

*Primary Examiner*—George H. Krizmanich
*Attorney, Agent, or Firm*—Craig & Antonelli

[57] ABSTRACT

A screw conveyor centrifuge of the type having a hollow cylindrical and/or conical shaped bowl or shell and a conveyor screw extending through the bowl. The bowl and the screw are both rotatable, but at different rotative velocities. A solid-liquid mixture is fed into one end of the conveyor and the solid portion thereof is transferred away from the opposite end after being separated out of the liquid as it is conveyed along the centrifugally rotating bowl by the screw. The liquid portion of the mixture is conducted away from a receiving point intermediate the ends of the conveyor by way of fluid drain structure disposed immediately adjacent the outside surface of the hub of the screw means. In several embodiments, the fluid drain structure consists of pipes extending axially from the receiving point through holes in portions of the flights of the screw to a drain chamber disposed immediately adjacent the beginning end of the conveyor screw. These pipes are detachably mounted and interchangeable with pipes of varying cross-section and lengths. Also, the radial position of the pipes may be changed to adapt to varying liquid levels in the bowl. Other embodiments use a multiple helix screw with alternate channels serving as the fluid drain structure. The flights intermediate the alternate channels may be interrupted at their rims or have apertures therethrough in the area of the receiving point.

11 Claims, 8 Drawing Figures

IIIa
16
5
IIIa

III b
15a
15b
15c
15d
7
15c
15b
15d
15a
III b

SOLID-SHELL SCREW-CONVEYOR CENTRIFUGE

BACKGROUND AND SUMMARY OF THE INVENTION

The present invention relates to a solid-shell or bowl type screw-conveyor centrifuge for the continuous separation of solid-liquid mixtures. The type of centrifuge contemplated by the present invention has a rotating screw-conveyor arranged within a cylindrically and/or conically fashioned shell or bowl, which shell is also rotating at a different velocity than the screw to affect centrifugal forces on the material. The radial dimensions of the screw helix are adapted to the design of the shell or bowl to facilitate conveying operations. The solid-liquid material mixture to be separated is fed at the beginning of the screw conveyor path into a separating chamber formed between the screw hub and the bowl. At least one discharge opening for the solid proportion of the material to be separated is provided adjacent the end of the screw conveyor path. Also, at least one liquid discharge conduit for the liquid proportion of the material terminates into the separating chamber at a liquid pick-up or receiving point which receiving point is at a distance from the beginning of the screw conveyor path as seen in the conveying direction.

It has been contemplated to withdraw the liquid proportion from the separating chamber at the receiving point with the aid of a peeling or paring element. In these arrangements, the peeling element is disposed in or on the screw body, which screw body is correspondingly radially enlarged at the receiving point and is provided with perforations. Thus, the screw body, at the receiving point, dips relatively greatly into the separating chamber and thereby considerably narrows the effective conveying passage for the solids. Also, with this type of arrangement, relatively strong eddies are produced in the separating chamber due to the protruding enlargement in the screw body. A further disadvantage with this arrangement of the peeling element within the screw at the receiving point is the required complex construction and consequent high costs.

The present invention contemplates the provision of a centrifuge of the general type mentioned in the foregoing which overcomes the above discussed disadvantages. The arrangement of the present invention is improved and/or simplified with respect to both its function and its constructional arrangement.

The present invention contemplates overcoming the above discussed disadvantages by providing a drain conduit arrangement extending from the receiving point along the screw hub to a liquid proportion drain chamber or zone of the bowl or shell. The drain chamber contemplated by the present invention has at least one drain port leading to the outside of the conveyor shell structure and is separated from the separating chamber. This drain conduit arrangement makes it possible to discharge the liquid proportion without a peeling device, whereby the troublesome widening of the screw hub structure at the receiving point and the disadvantages connected therewith are avoided. Also, screw conveyor of the construction according to the present invention can be of a very simple structure.

In a preferred embodiment contemplated by the present invention, the material to be separated is fed to the screw hub through a hollow chamber which communicates with the beginning of the screw conveyor path. A sealing disk or gasket is provided adjacent the beginning of the screw conveyor path which disk is penetrated by the drain conduit. This sealing disk extends from the screw hub radially outwardly closely to the inner wall of the bowl. Portions of solids which accumulate in the transitional zone between the sealing disk and the bowl assist in sealing the separating chamber from the drain chamber. With this arrangment, a particularly simple separation is attained between the separating chamber and the drain chamber. This preferred embodiment also exhibits constructionally especially simple structures for the feed of the material to be separated into the hollow chamber of the screw hub and for the discharge of the liquid proportion from the drain chamber.

The drain conduit arrangements contemplated for some preferred embodiments of the present invention may utilize pipes, or troughs, which extend from the screw hub in closely adjacent disposition or spaced-apart in parallel relation to one another. The pipes or troughs can be various cross-sectional shapes, for example of a rectangular configuration. In one preferred embodiment, only two mutually opposed pipes or troughs are employed. The pipes or troughs can freely end in the screw flight range from which the purified liquid is to be discharged or withdrawn. However, it is also contemplated by the present invention to provide sealable openings in each screw flight in order to be able to withdraw the purified liquid at various points, depending on the material being centrifuged. The present invention also contemplates using pipes or troughs of varying longitudinal dimension to effect withdrawal of the liquid at various points. In some particularly preferred embodiments of the invention, the pipes or troughs are accessible through drain bores in the lid or and of the bowl or shell. With this last-mentioned arrangement, it is possible to utilize pipes or troughs of varying lengths selectively, and to reduce or enlarge the cross section of the pipes by the insertion of plastic or metal strips for the purpose of changing the flow rate of the purified liquid. This arrangement makes it possible to readily remove any possible residual sedimentation from the pipes and/or troughs by removing the pipes or troughs and cleaning same.

In another preferred embodiment of the present invention, the pipes and/or troughs are disposed to be adjustable with respect to their radial distance from the longitudinal rotational axis of the screw. This radial adjustability feature makes it possible to maintain the immersion depth of the pipes and/or troughs at the optimum position suitable for the treatment of each of various solid-liquid materials to be separated. Furthermore, liquids of different densities can be withdrawn with this arrangement. In this connection, it is to be noted that it is merely necessary to seal the point of penetration of the pipes and/or troughs through the sealing disk adjacent the drain chamber. Sealing devices are unnecessary in the passages through the screw helix that are located between the sealing disk and the receiving point.

Further, particularly interesting embodiments of the invention are obtained by utilizing, in a double-flight or multi-flight screw construction, part of the channels, at least one, as conveyor channels, whereas the remaining part of the channels, at least one, serves as the drain conduit. The channels serving as conveyor channels are communicated with the feed of the material to be separated while the channels serving as drain conduit channels are communicated with the drain chamber. The conveyor channels and the drain channels are in communication with one another at the receiving point. This double usage of the channels between multiple-flight screw helix blades is workable as the gap between the individual screw flights and the inner wall of the bowl or shell is practically sealed off by solids after shortly after the material mixture is introduced. This sealing action can be improved according to the present invention by providing longitudinal strips within the bowl, between which a solids film is retained. Accordingly, the drain channel or channels are separated from the conveyor channel or channels except for the connection at the receiving point. Basically, the material to be separated can be fed into the conveyor channel or channels from the wider end face of the bowl in the peripheral zone thereof. The liquid proportion obtained in the same end of the bowl in the drain channel or channels is withdrawn, for example with the aid of a peeling element, and removed through the screw hub. However, in a preferred embodiment, here again a sealing disk is utilized, as described hereinabove. Under this prerequisite, a double-flight screw equipped in accordance with the invention operates as follows:

The material to be separated is introduced into the separating chamber through a cavity in the screw hub and through corresponding perforations in the casing of the screw hub in the initial zone of the screw conveyor path and fed into one of the two screw channels sealed at the front face by the sealing disk. The material to be separated travels along this screw channel in the direction of the smaller bowl diameter. At the receiving point which is suitably provided at the point where the maximum clarification of the material present in the conveyor channel has been attained, the liquid proportion flows through the connection provided at that point between the screw conveyor channel into the drain screw channel, which drain screw channel is not charged with material to be separated. The connection can be effected in the form of simple openings disposed in the screw flight between the conveyor channel and the drain channel and arranged suitably approximately at the height of the liquid level of the bowl. The liquid proportion transferred through the openings into the drain channel flows therein along the screw thread back to the larger diameter of the bowl. The drain channel penetrates the sealing disk, preferably likewise at the height of the liquid level, so that the liquid proportion can flow off via the weir disk or via a peeling element or the like.

A special advantage in removing the liquid proportion according to the present invention by means of one or more separate screw channels resides in that, in these drain channels, a further additional sedimentation of finer solids can definitely take place without these finer solids being able to clog the drain conduit constituted by the drain channel. Not only does clogging not take place in the drain channels, the entire drain channel is available for a further clarification of the liquid proportion, since the thus-sedimented finer solids are seized by the screw and are conveyed in the direction of the smaller bowl diameter. Therefore, in an especially advantageous embodiment, the screw helix is provided with an interruption between the conveyor channel and the drain channel, which interruption is arranged at least in the zone of the screw helix facing the inner wall of the bowl. This interruption can form the connection between the conveyor channel and the drain channel by itself or additionally to other openings. Preferably, the interruption is provided in the initial zone of the bowl portion wherein the fine, sedimented solids have not yet been removed from the liquid. Since these find solids cause more or less great difficulties during their conveyance from the liquid level, the screw helix is suitably interrupted in such a manner that the fine solids are placed upstream of the coarser solids in the conveyor channel of the screw and can thus be more readily transported from the liquid zone into the dry zone.

In case of triple-flight screws, it is possible according to the present invention, to fashion two screw channels as conveyor channels and one screw channel as the drain channel. Also the reverse is possible. If, quite generally, the screw has more than two channels, for example $n$ channels, then a number of 1 to $n - 1$ channels can be provided as conveyor channels and in each case the residual number can be provided as drain channels. The particular distribution of the drain and conveyor channels contemplated by the present invention will be extensively dependent on the consistency of the material to be separated. Also, the present invention contemplates making a screw channel serving as the drain channel narrower than a screw channel serving as the conveyor channel, in order to thereby make a larger clarifying volume available for the conveyor channel or channels.

The present invention also contemplates constructing the screw in such a manner that the drain channel is extended only up to the receiving point, while the conveyor channel is then further extended as a single-flight screw to the narrow end of the bowl. This arrangement has the advantage that, at the point where the solid substance is transferred from the liquid zone into the dry zone, the screw which is single-flight in this region can be provided with a flatter pitch, which flatter pitch improves the conveyance of particularly slurry-like or sludge-like solids. the present invention also contemplates employing normal, double - or multi-flight screws, with the corresponding openings or screw flight interruptions being provided at the receiving point and the drain channel or channels extended through the sealing disk. The present invention also contemplates arrangements with double-flight screws wherein an additional, narrow screw drain channel is provided, extending between the two screw channels.

The above-discussed and other objects, features and advantages of the present invention will become more apparent from the following detailed description thereof, when taken in connection with the accompanying drawings, which show, for the purposes of illustration only, several embodiments in accordance with the present invention.

DETAILED DESCRIPTION OF THE DRAWINGS

Figure 1:
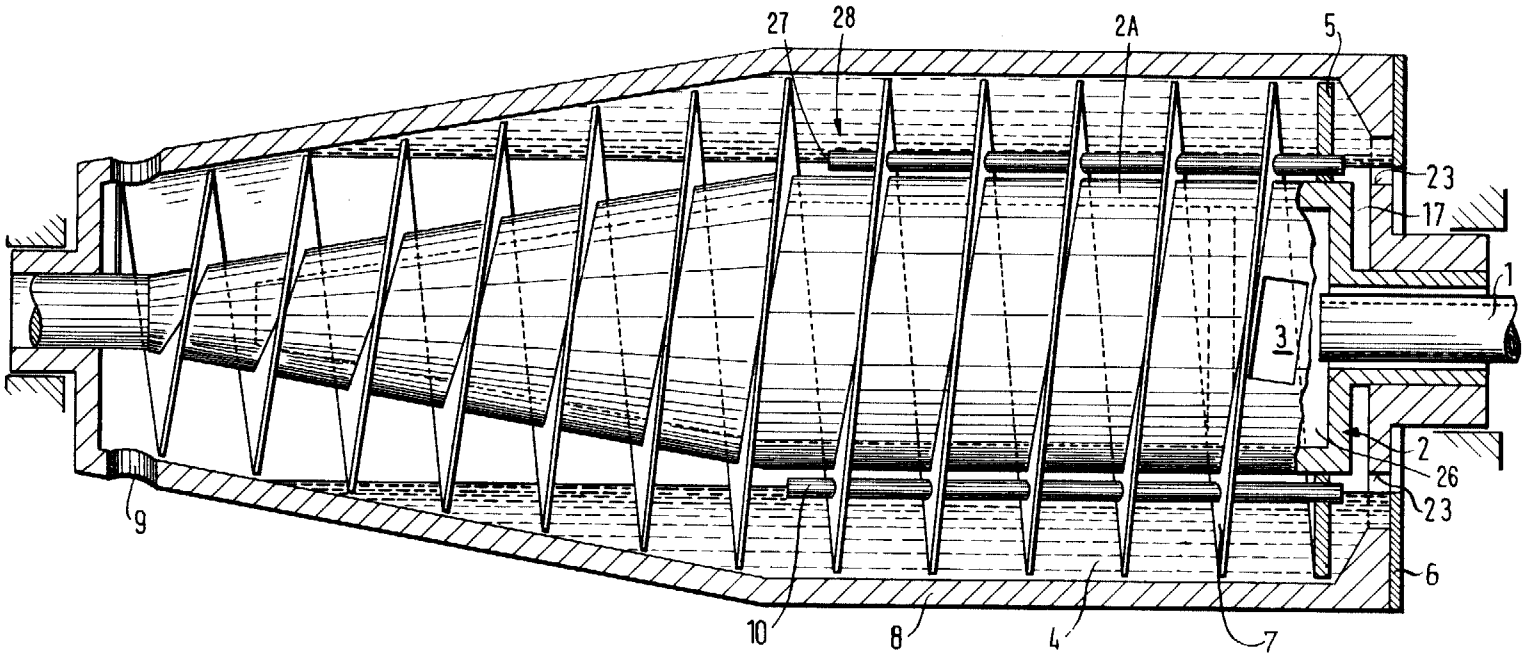
FIG. 1 is a schematic, partial cross-sectional view showing a longitudinal section through a first embodiment of the present invention.

The accompanying drawings and the following detailed description thereof include those features of the present invention necessary for a complete understanding of the invention and for enabling one to construct and practive the various embodiments thereof. It will be understood that those features of the centrifuge not specifically illustrated and described, such as: means for imparting rotative motion to each of the screw and bowl, means for feeding the liquid-solid material mixture to the feed pipe, means for transferring the solid material away from the solid discharge openings, and means for transferring the purified or clarified liquid from the drain chamber; may be of constructions known to those skilled in the art.

In the following description, like reference numerals are used throughout the various figures to represent like structures.

Referring to the drawings, and particularly to FIG. 1, a feed pipe 1 is arranged for feeding the solid-liquid mixture to be separated to the inside of the right hand end of the hub 2A on screw body 2. This feed pipe 1 is advantageously to be constructed short and large in volume. The material is fed from the hub into the separating chamer 4 of the centrifuge by way of hollow space 26 of the hub 2A and perforations 3 in the screw body wall. A sealing disk 5 is attached to the screw at the end thereof adjacent the larger bowl diameter to prevent the material to be separated from passing over a weir disk 6 arranged at the end of the bowl. Since the material to be separated can't travel past the disk 5, it travels along the screw channel formed by a screw helix or flight 7 in the direction of the smaller bowl diameter. The solids in the material mixture are sedimented by centrifugal action due to rotation of the bowl onto the bowl wall 8 and are conveyed by the screw, which latter precedes the bowl with a certain difference in the speed of rotation, in the direction of the smaller bowl diameter. Near the end of the bowl with the smaller diameter, the solids are pushed out of the liquid level by the screw and are then ejected through discharge ports 9. The liquid, which is clarified by the centrifuging, sedimenting and discharge of the solids, flows through drain pipes 10 which are extended through the screw helix flights 7. Drain pipes 10 receive the liquid by way of liquid discharge openings 27 in the area of receiving point 28. These drain pipes 10 penetrate the sealing disk 5 to communicate the liquid with the drain chamber 17. The liquid flows from the drain chamber via the weir disk 6 to a liquid collecting place (not shown).

Figures 2A, 2B:
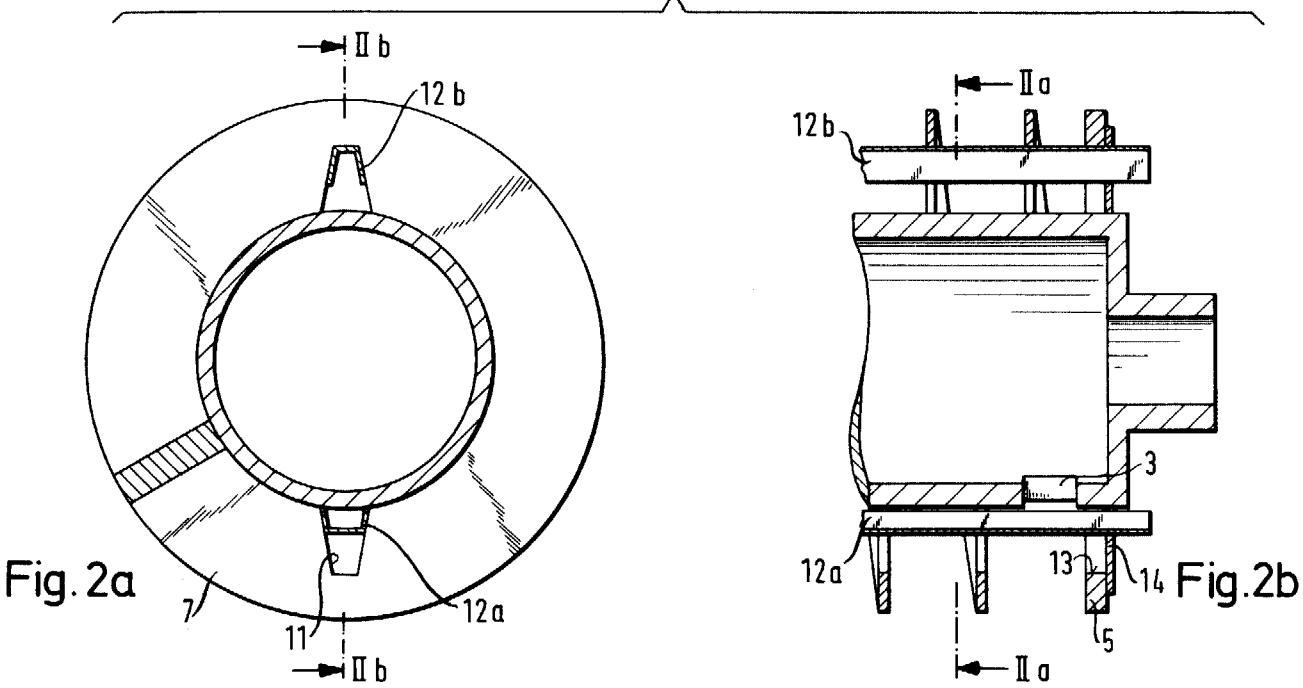
FIG. 2*a* is a schematic, partial cross-sectional view showing a transverse section through a further embodiment of the present invention which shows details for adapting to various liquid levels in the bowl.
FIG. 2*b* is a partial longitudinal section of the embodiment shown in FIG. 2*a*.

FIGS. 2*a* and 2*b* show sections through the screw of a further embodiment. Conical cutouts 11 are formed in the screw helix 7 for the acceptance of drain troughs 12*a* or 12*b* which ae also of a conical cross-section. A trough or a plurality of troughs, such as trough 12*a* are inserted if the device is to be operated with a high liquid level, and the trough 12*b* is utilized when a low liquid level is required for the operation. A perforation 13 extends through the sealing disk 5 for communicating the trough 12*a* or 12*b* to the drain chamber (drain chamber such as shown at 17 in FIG. 1). The perforation 13 (or perforations if more than one trough is used) is sealed by a metal sheet or plate 14 which can be connected with the trough 12*a* or 12*b*.

Figures 3, 3A, 3B:
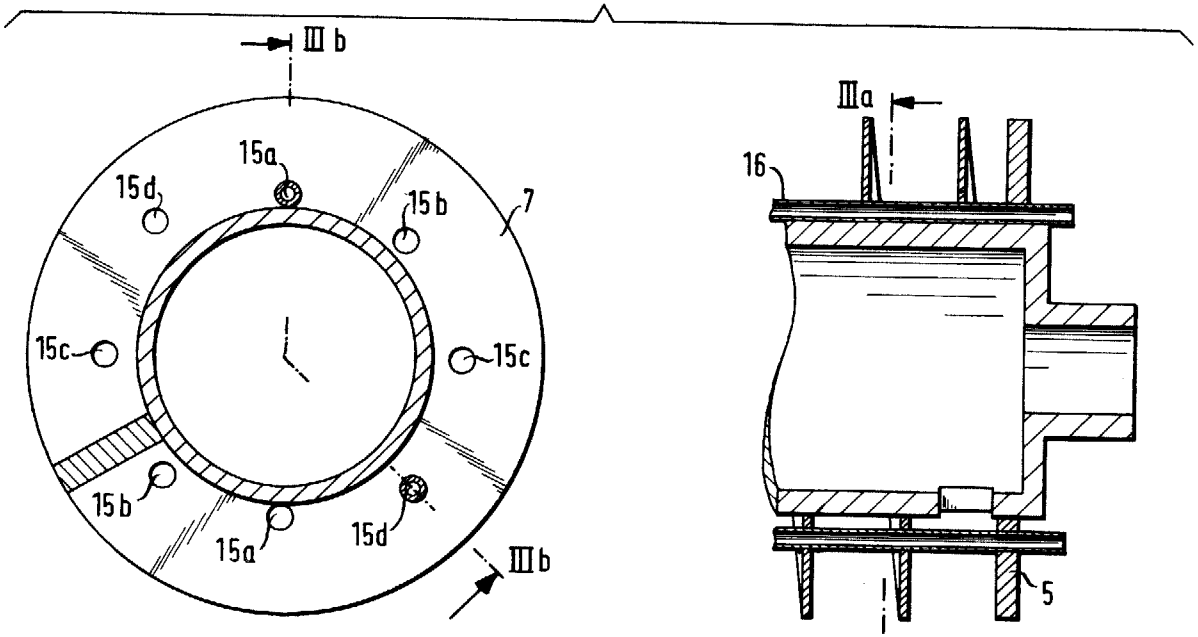
FIG. 3*a* is a schematic, partial cross-sectional view showing a transverse section through a third embodiment of the present invention which shows details for adapting to various liquid levels in the bowl.
FIG. 3*b* is a partial longitudinal section of the embodiment shown in FIG. 3*a;*

FIGS. 3*a* and 3*b* show sections through the screw of a third embodiment. In the screw helix 7 — or, in case of multiple-flight screws, in the screw helices 7 — bores 15*a* through 15*d* are disposed in parallel to the screw axis with varying radial spacings from this axis, wherein respectively two mutually opposed bores (with similar reference numerals in FIG. 3*a*) exhibit the same radial spacing. Drain pipes 16 are insertable into these bores and are adaptable to a desired change in the level of the liquid by inserting them in corresponding bores. The sealind disk 5 has corresponding bores for communicating the pipes 16 with the drain chamber. Sealing means (not shown) are provided for closing unused bores in the sealing disk 5.

Figure 4:
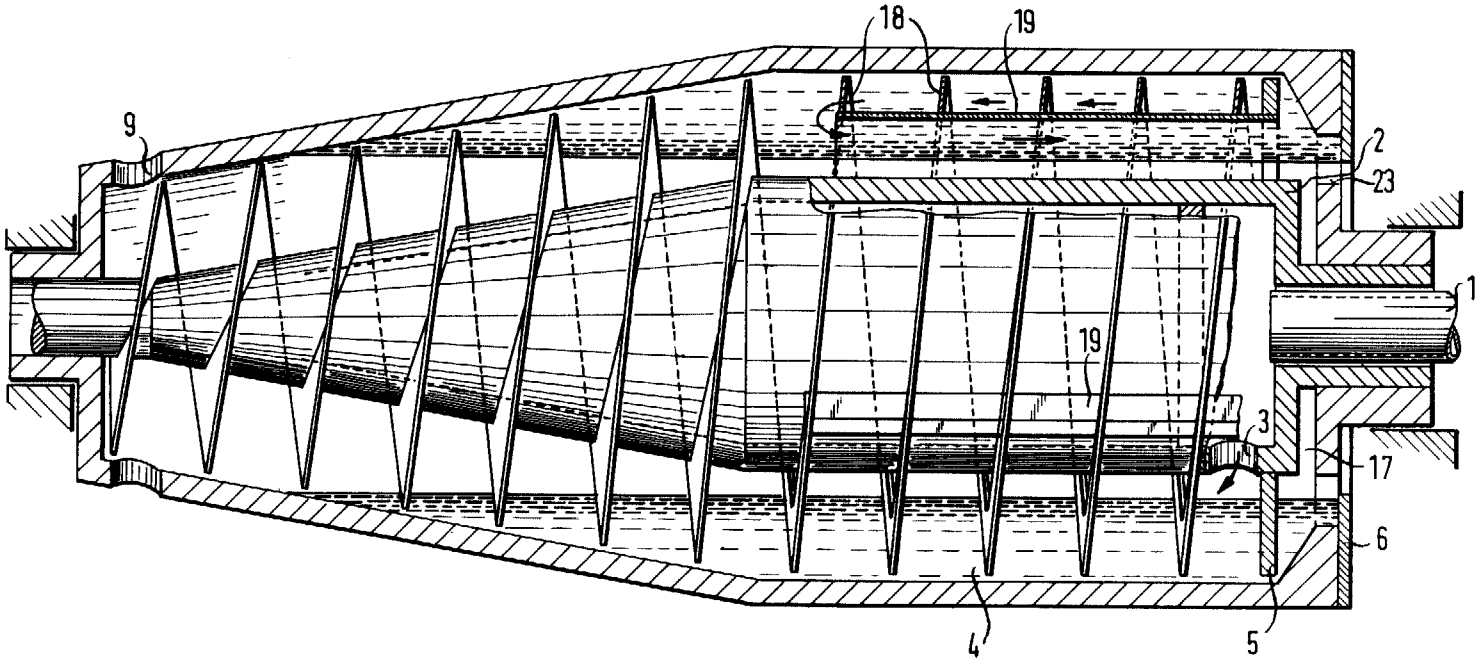
FIG. 4 is a schematic partial cross-sectional view showing a longitudinal section through another embodiment of the present invention with a screw of a low screw flight depth.

In the embodiment according to FIG. 4, a section is illustrated through a centrifuge with a screw of a low flight depth. In such screws with a low flight depth, the screw helices 18 are disposed on longitudinally extending supporting webs 19 which are carried by the screw body 2. The supporting webs 19 are of hollow construction and are advantageously employed as the drain conduit means. The supporting webs 19 penetrate the sealing disk 5 to communicate the liquid with the drain chamber 17.

In the FIG. 4 embodiments the material to be separated enters the separating chamber 4 of the centrifuge through the feed pipe 1 and the perforations 3 in the screw body wall. While the solids are sedimented, the liquid now travels in parallel to the axis of the screw between the sections of the screw flight 18 provided at a spacing from the screw body 2 and the screw body 2 proper in the direction of the small bowl diameter (as indicated by the left hand facing arrows in FIG. 4). At the receiving point, (the left hand end of webs 19), the thus-purified liquid can now be discharged through the hollow-constructed supporting webs 19 (as indicated by the right hand facing arrows in FIG. 4) penetrating the sealing disk 5 into the drain chamber 17 and from there toward the outside via the weir disk 6. Inserts or linings of plastic or metal can be inserted in the supporting webs 19 to cause a higher flow velocity rate due to a corresponding reduction in cross section, in order to prevent as much as possible any sedimentation within the supporting webs, or at least to keep such sedimentation at a minimum.

Figure 5:
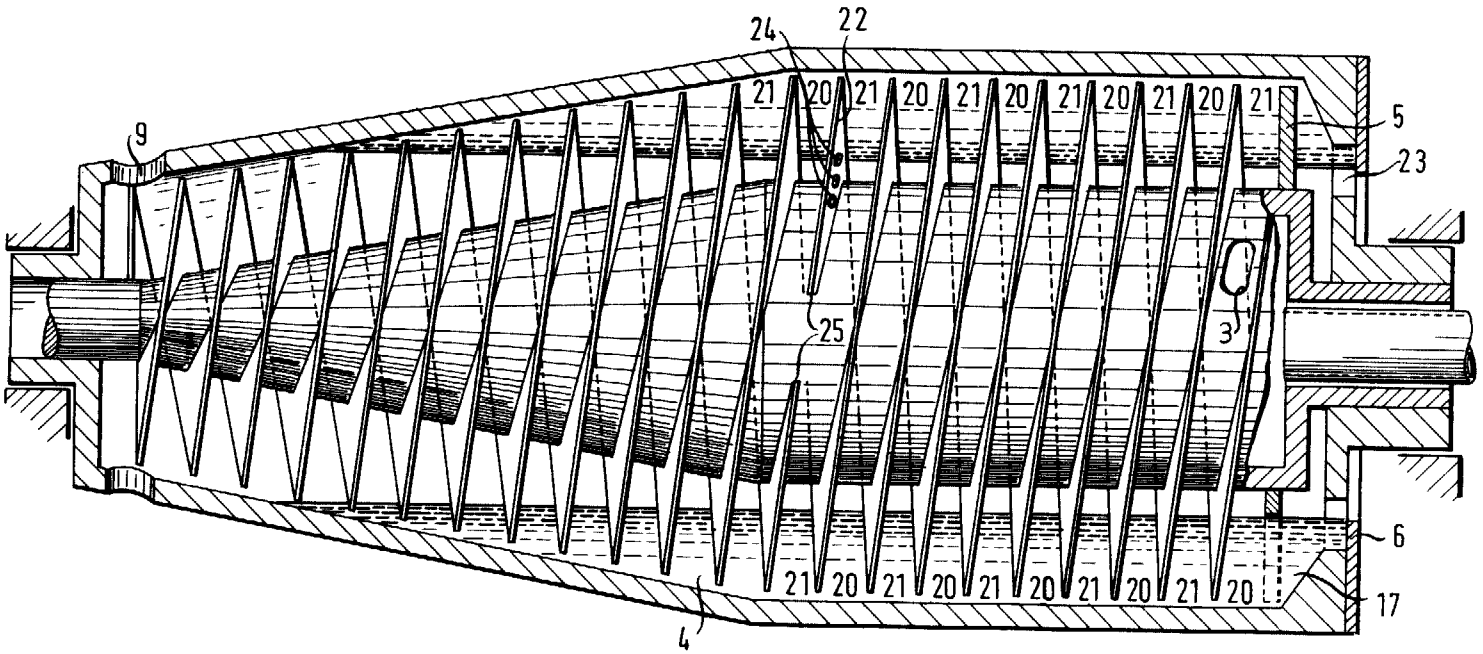
FIG. 5 is a schemtic partial cross-sectional view showing a longitudinal section through an embodiment of the present invention with a double-flight screw, of which one screw channel is fashioned as a conveyor channel and the other as a drain channel.

FIG. 5 shows a section through an embodiment of a centrifuge with a double-flight screw wherein one screw channel 20 is utilized as a drain conduit for removing the purified liquid. The material to be separated again enters through one or more perforations 3 in the screw body wall into the separating chamber 4 of the centrifuge. This material to be separated enters into the other screw channel 21, the end of which channels 21 is sealed by the sealing disk 5 at the larger bowl diameter.

Since any drainage into the drain chamber 17 and out via the weir disk 6 is prevented by the sealing disk 5, the material to be separated passes within the screw channel 21 serving as the conveyor channel until it reaches the receiving point where the screw flight 22 separating the two screw channels is perforated by, for example, openings 24. Here, the purified liquid present on the radially inwardly facing surface of the liquid level passes over into the screw channel 20 serving as the drain channel and travels in the channel 20 back to the larger bowl diameter. The sealing disk 5 is perforated in the zone of the intersections with drain channel 20 to permit the liquid to enter the drain chamber 17. The purified liquid thus passes through the drain channel 20 and the perforation of the sealing disk 5 into the drain chamber 17 and from there flows off through outlet openings 23 defined by the weir disk 6.

Fine solid substances which may possibly still settle within the drain screw channel 20, due to incomplete sedimentation during travel in conveyor channels 21, is seized by the screw and is pushed up to the discharge opening 9. Since difficulties may arise in many cases in conveying fine solids from the liquid zone into the dry zone (where the screw leaves the liquid level adjacent the left hand side of FIG. 5), it is also contemplated to provide an interruption, or interruptions, 25 in the screw flight 22 separating the drain channel from the conveyor channel, through which interruption the fine solids are transferred from the drain channel into the conveyor channel. With this arrangement of interruption 25, the fine solids are disposed upstream of the coarser solids already pushed ahead by the conveyor channel 21, which coarser solids further assist the conveyance of the fine solids. The interruption 25 in the screw flight need not absolutely be in the region of the receiving point. It is also contemplated to provide the interruption, or interruptions only in the zone of the outer diameter of the screw helix facing the bowl wall. That is, the interruption need not extend radially inwardly to the hub body of the screw conveyor. The interruption 25 of the screw helix can also be disposed in the zone of the receiving point and can simultaneously serve for the transfer of the liquid from the conveyor channel into the drain channel. Also, suitably, the interruption 25 may be somewhat axially offset with respect to the receiving point in the direction of the smaller bowl diameter, so that the point of liquid transfer from the conveyor channel into the drain channel is at a distance from the transfer of the fine solids from the drain channel into the conveyor channel.

Figure 6:
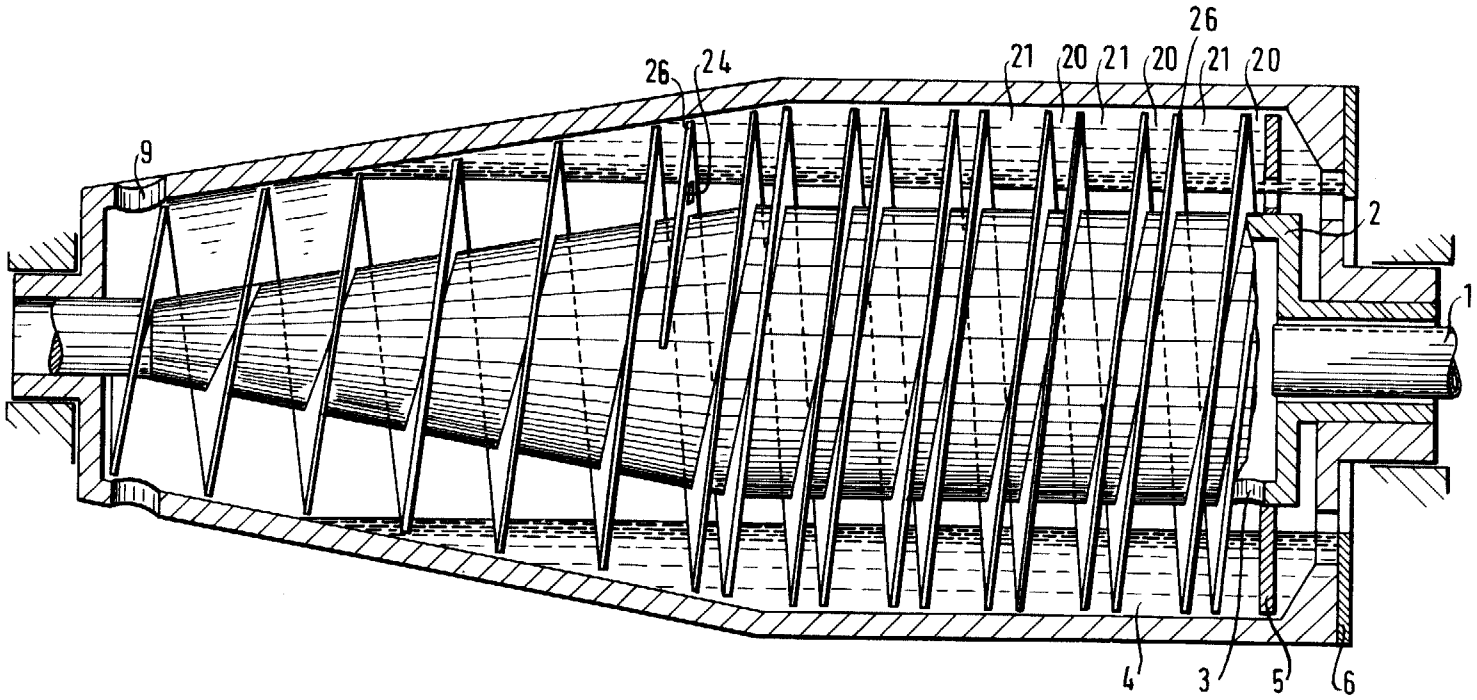
FIG. 6 is a schematic partial cross-sectional view showing a longitudinal section through a further embodiment of the present invention with a double-flight screw construction modified as compared to that of FIG. 5.

In the embodiment according to FIG. 6, a double-flight screw is provided, the two channels 20, 21 of which are of differeing widths as seen in the longitudinal axis of the screw. The axially wider screw channel 21 serves here for the conveyance of the material to be separated, whereas the axially narrower screw channel 20 is fashioned as the drain channel for the purified liquid. This has the advantage that, in this embodiment, the conveyed volume is increased as compared to that of FIG. 5. Moreover, the screw flight 26 which separates the conveyor channel from the drain channel is extended in the direction of the smaller bowl diameter only up to shortly beyond the receiving point, which is formed by the interruption 24 of the screw flight. The fine solids sedimented in the drain channel pass over, at the end of the screw flight 26, into the then only remaining conveyor channel of the screw and are entrained by the coarser sedimented solids in the conveyor channel and thus are more efficiently transported into the dry zone.

In a further modification of the embodiment illustration of FIG. 6, the part of the conveyor channel extending between the end of the screw flight 26 and the discharge opening 9 can be provided with a flatter axial pitch, whereby the conveyance of slurry-like solids can be improved.

The embodiments illustrated in FIGS. 5 and 6 have the additional advantages, as compared to the remaining embodiments with drain troughs or pipes, that a sedimentation in the drain conduit is possible or is even purposely provided, and that, when changing the liquid level by means of a different weir disk, no further alteration must be performed to adjust the drain conduit to the changed liquid level.

While I have shown and described only several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A screw-conveyor centrifuge for the continuous separation of solid-liquid mixtures comprising: a longitudinally extending rotatable bowl having inwardly facing surfaces defining a hollow space, a longitudinally extending conveyor screw means arranged in said bowl for relative rotation with respect to said bowl, said screw means including a centrally disposed hub means and helically wound screw fligh means extending radially outwardly from said hub means, the outer radial dimensions of said flight means corresponding to the inwardly facing surfaces of said bowl, said flight means extending from adjacent a first end of said bowl corresponding to the beginning of the conveyor path of said screw means to adjacent the second end of said bowl corresponding to the end of said conveyor path, a separating chamber formed between the hub means and the inwardly facing surfaces of the bowl, feeding means for feeding the solid-liquid mixture to the separating chamber at a position adjacent the first end of the bowl, solid discharge means arranged adjacent the second end of the bowl for discharging solid material separated out in the separating chamber, and liquid discharge means for discharging the liquid material portion of the solid-liquid mixture from the bowl; wherein said liquid discharge means includes: at least one liquid discharge opening terminating in the separating chamber at a receiving point which is at a distance in the conveying direction from the first end of the bowl, drain chamber means separated from said separating chamber, at least one drain port leading to the outside from said drain chamber means, and drain conduit means extending along the screw means from the liquid discharge opening to the drain chamber means, wherein the drain conduit means extends in an axial direction along at least that portion of the length thereof which is adjacent the drain chamber means, and wherein the drain conduit means terminates with an open end thereof facing said drain chamber means in axial alignment with said at least one drain port for accommodating access to said drain conduit means from the outside by way of the at leat one drain port, and wherein said drain conduit means is positioned radially outwardly from said hub means.

2. A centrifuge according to claim 1, wherein said bowl is of circular cross-section throughout the longitudinal extent thereof, and wherein said first end is of a greater diameter than said second end.

3. A centrifuge according to claim 1, wherein said hub means is of solid construction throughout most of its length.

4. A centrifuge according to claim 1, wherein said drain conduit means is positioned radially inwardly of the outer radial dimensions of the flight means.

5. A screw-conveyor centrifuge for the continuous separation of solid-liquid mixtures comprising: a longitudinally extending rotatable bowl having inwardly facing surfaces defining a hollow space, a longitudinally extending conveyor screw means arranged in said bowl for relative rotation with respect to said bowl, said screw means including a centrally disposed hub means and helically wound screw flight means extending radially outwardly from said hub means, the outer radial dimensions of said flight means corresponding to the inwardly facing surfaces of said bowl, said flight means extending from adjacent a first end of said bowl corresponding to the beginning of the conveyor path of said screw means to adjacent the second end of said bowl corresponding to the end of said conveyor path, a separating chamber formed between the hub means and the inwardly facing surfaces of the bowl, feeding means for feeding the solid-liquid mixture to the separating chamber at a position adjacent the first end of the bowl, solid discharge means arranged adjacent the second end of the bowl for discharging solid material separated out in the separating chamber, and liquid discharge means for discharging the liquid material portion of the solid-liquid mixture from the bowl; wherein said liquid discharge means includes: at least one liquid discharge opening terminating in the separating chamber at a receiving point which is at a distance in the conveying direction from the first end of the bowl, drain chamber means separated from said separating chamber, at least one drain port leading to the outside from said drain chamber means, and drain conduit means extending along the screw means from the liquid discharge opening to the drain chamber means, wherein the drain conduit means extends in an axial direction along at least that portion of the length thereof which is adjacent the drain chamber means, and wherein the drain conduit means terminates with an open end thereof facing said drain chamber means in axial alignment with said at least one drain port for accommodating access to said drain conduit means from the outside by way of the at least one drain port, and wherein said feeding means includes a hollow space provided in said hub means adjacent the first end of the bowl.

6. A centrifuge according to claim 5, wherein said drain chamber means is located adjacent the first end of the bowl, and wherein a sealing disk is provided between the separating chamber and the drain chamber means, said drain conduit means extending through perforation means provided in said sealing disk.

7. A centrifuge according to claim 6, wherein said sealing disk extends radially from the outer surface of said hub means to immediately adjacent the inwardly facing surfaces of the bowl such that said sealing disk, in conjunction with portions of said solid material portion, seals the radially outermost extent of said separating chamber from said drain chambers means.

8. A centrifuge according to claim 7, wherein said drain conduit means includes a plurality of separate parallel conduit means spaced from one another about the circumference of said hub means.

9. A screw-conveyor centrifuge for the continuous separation of solid-liquid mixtures comprising: a longitudinally extending rotatable bowl having inwardly facing surfaces defining a hollow space, a longitudinally extending conveyor screw means arranged in said bowl for relative rotation with respect to said bowl, said screw means including a centrally disposed hub means and helically wound screw flight means extending radially outwardly from said hub means, the outer radial dimensions of said flight means corresponding to the inwardly facing surfaces of said bowl, said flight means extending from adjacent a first end of said bowl corresponding to the beginning of the conveyor path of said screw means to adjacent the second end of said bowl corresponding to the end of said conveyor path, a separating chamber formed between the hub means and the inwardly facing surfaces of the bowl, feeding means for feeding the solid-liquid mixture to the separating chamber at a position adjacent the first end of the bowl, solid discharge means arranged adjacent the second end of the bowl for discharging solid material separated out in the separating chamber, and liquid discharge means for discharging the liquid material portion of the solid-liquid mixture from the bowl; wherein said liquid discharge means includes: at least one liquid discharge opening terminating in the separating chamber at a receiving point which is at a distance in the conveying direction from the first end of the bowl, drain chamber means separated from said separating chamber, at least one drain port leading to the outside from said drain chamber means, and drain conduit means extending along the screw means from the liquid discharge opening to the drain chamber means, wherein the drain conduit means extends in an axial direction along at least that portion of the length thereof which is adjacent the drain chamber means, and wherein the drain conduit means terminates with an open end thereof facing said drain chamber means in axial alignment with said at least one drain port for accommodating access to said drain conduit means from the outside by way of the at least one drain port, and wherein the drain chamber means includes a lid on the side thereof spaced from said separating chamber, wherein the drain conduit means consists of ducts extending parallel to the axis of rotation of said conveyor screw means and terminating into the drain chamber means, said at least one drain port being arranged in said lid, each of said ducts being in axial alignment with the at least one drain port for providing access to said ducts from the outside by way of said at least one drain port.

10. A screw-conveyor centrifuge for the continuous separation of solid-liquid mixtures comprising: a longitudinally extending rotatable bowl having inwardly facing surfaces defining a hollow space, a longitudinally extending conveyor screw means arranged in said bowl for relative rotation with respect to said bowl, said screw means including a centrally disposed hub means and helically wound screw flight means extending radially outwardly from said hub means, the outer radial dimensions of said flight means corresponding to the inwardly facing surfaces of said bowl, said flight means extending from adjacent a first end of said bowl corresponding to the beginning of the conveyor path of said screw means to adjacent the second end of said bowl corresponding to the end of said conveyor path, a separating chamber formed between the hub means and the inwardly facing surfaces of the bowl, feeding means for feeding the solid-liquid mixture to the separating chamber at a position adjacent the first end of the bowl, solid discharge means arranged adjacent the second end of the bowl for discharging solid material separated out in the separating chamber, and liquid discharge means for discharging the liquid material portion of the solid-liquid mixture from the bowl; wherein said liquid discharge means includes: at least one liquid discharge opening terminating in the separating chamber at a receiving point which is at a distance in the conveying direction from the first end of the bowl, drain chamber means separated from said separating chamber, at least one drain port leading to the outside from said drain chamber means, wherein the drain conduit means extending in an axial direction along at least that portion of the length thereof which is adjacent the drain chamber means, and wherein the drain conduit means terminates with an open end thereof facing said drain chamber means in axial alignment with said at least one drain port for accommodating access to said drain conduit means from the outside by way of the at least one drain port, wherein said drain conduit means extend in said axial direction along the entire length thereof from said drain chamber means to said liquid discharge opening, and wherein said drain conduit means includes a plurality of separate parallel conduit means spaced from one another about the circumference of said hub means, each of said conduit means opening into said drain chamber means and said liquid discharge opening, each of said conduit means extending in said axial direction along the entire length thereof and being in alignment with said at least one drain port.

11. A screw-conveyor centrifuge for the continuous separation of solid-liquid mixtures comprising: a longitudinally extending rotatable bowl having inwardly facing surfaces defining a hollow space, a longitudinally extending conveyor screw means arranged in said bowl for relative rotation with respect to said bowl, said screw means including a centrally disposed hub means and helically wound screw flight means extending radially outwardly from said hub means, the outer radial dimensions of said flight means corresponding to the inwardly facing surfaces of said bowl, said flight means extending from adjacent a first end of said bowl corresponding to the beginning of the conveyor path of said screw means to adjacent the second end of said bowl corresponding to the end of said conveyor path, a separating chamber formed between the hub means and the inwardly facing surfaces of the bowl, feeding means for feeding the solid-liquid mixture to the separating chamber at a position adjacent the first end of the bowl, solid discharge means arranged adjacent the second end of the bowl for discharging solid material separated out in the separating chamber, and liquid discharge means for discharging the liquid material portion of the solid-liquid mixture from the bowl; wherein said liquid discharge means includes: at least one liquid discharge opening terminating in the separating chamber at a receiving point which is at a distance in the conveying direction from the first end of the bowl, drain chamber means separated from said separating chamber, at least one drain port leading to the outside from said drain chamber means, and drain conduit means extending along the screw means from the liquid discharge opening to the drain chamber means, wherein the drain conduit means extends in an axial direction along at least that portion of the length thereof which is adjacent the drain chamber means, and wherein the drain conduit means terminates with an open end thereof facing said drain chamber means in axial alignment with said at least one drain port for accommodating access to said drain conduit means from the outside by way of the at least one drain port, and wherein said hub is of hollow construction with walls thereof forming radially inner boundaries of said separating chamber, and wherein said feeding means includes an opening through the wall of said hub for communicating the solid-liquid mixture from inside said hub to said separating chamber.

* * * * *